United States Patent [19]

Huber et al.

[11] Patent Number: 4,933,617

[45] Date of Patent: Jun. 12, 1990

[54] SERVO STEERING SYSTEM FOR MOTOR BOATS

[75] Inventors: Gerhard Huber, Frankenhofen; Ferdinand Gruber, Eptach, both of Fed. Rep. of Germany

[73] Assignee: Hoerbiger Hydraulik GmbH, Fed. Rep. of Germany

[21] Appl. No.: 229,435

[22] Filed: Aug. 8, 1988

[30] Foreign Application Priority Data

Aug. 12, 1987 [AT] Austria ..... 2035/87

[51] Int. Cl.[5] ..... G05D 1/00; B63H 25/04

[52] U.S. Cl. ..... 318/588; 318/589; 114/144 R; 114/150; 91/388; 91/461; 91/509

[58] Field of Search ..... 318/589, 588, 599, 632, 318/640, 434, 610, 621, 624, 678, 565, 287, 564, 563, 650, 286; 388/823; 114/144 R, 144 C, 144 RE, 150; 91/461, 464, 465, 388, 509, 510

[56] References Cited

U.S. PATENT DOCUMENTS

| | | | |
|---|---|---|---|
| 3,468,126 | 9/1969 | Mercier | 114/150 X |
| 3,482,398 | 12/1969 | Christensen | 91/509 X |
| 3,508,400 | 4/1970 | Mercier | 114/150 X |
| 3,798,525 | 3/1974 | Cooper | 318/588 |
| 3,799,096 | 3/1974 | Jeffery et al. | 114/150 |
| 3,847,060 | 11/1974 | Jasinski et al. | 91/461 X |
| 3,946,690 | 3/1976 | Holtz et al. | 318/588 X |
| 3,995,205 | 11/1976 | Klees | 318/589 |
| 4,209,986 | 7/1980 | Cunningham | 114/150 X |
| 4,266,497 | 5/1981 | Toda et al. | 114/144 R |
| 4,362,117 | 12/1982 | Mishina | 114/150 |
| 4,408,555 | 10/1983 | Aung | 114/150 |
| 4,510,847 | 4/1985 | Mucheyer et al. | 91/388 X |
| 4,681,055 | 7/1987 | Cyr | 318/588 X |

*Primary Examiner*—William M. Shoop, Jr.
*Assistant Examiner*—Paul Ip
*Attorney, Agent, or Firm*—Watson, Cole, Grindle & Watson

[57] ABSTRACT

In a servo steering system for motor boats comprising a steering wheel which mechanically acts on the position of a hydraulic control valve, and a rubber cylinder connected to a hydraulic power unit by way of the control valve, the control valve comprises an additional adjustment unit which is connected to an autopilot unit and is controllable by this latter. In this way both normal servo-assisted hand-steering and autopilot steering are made possible in a simple manner.

4 Claims, 1 Drawing Sheet

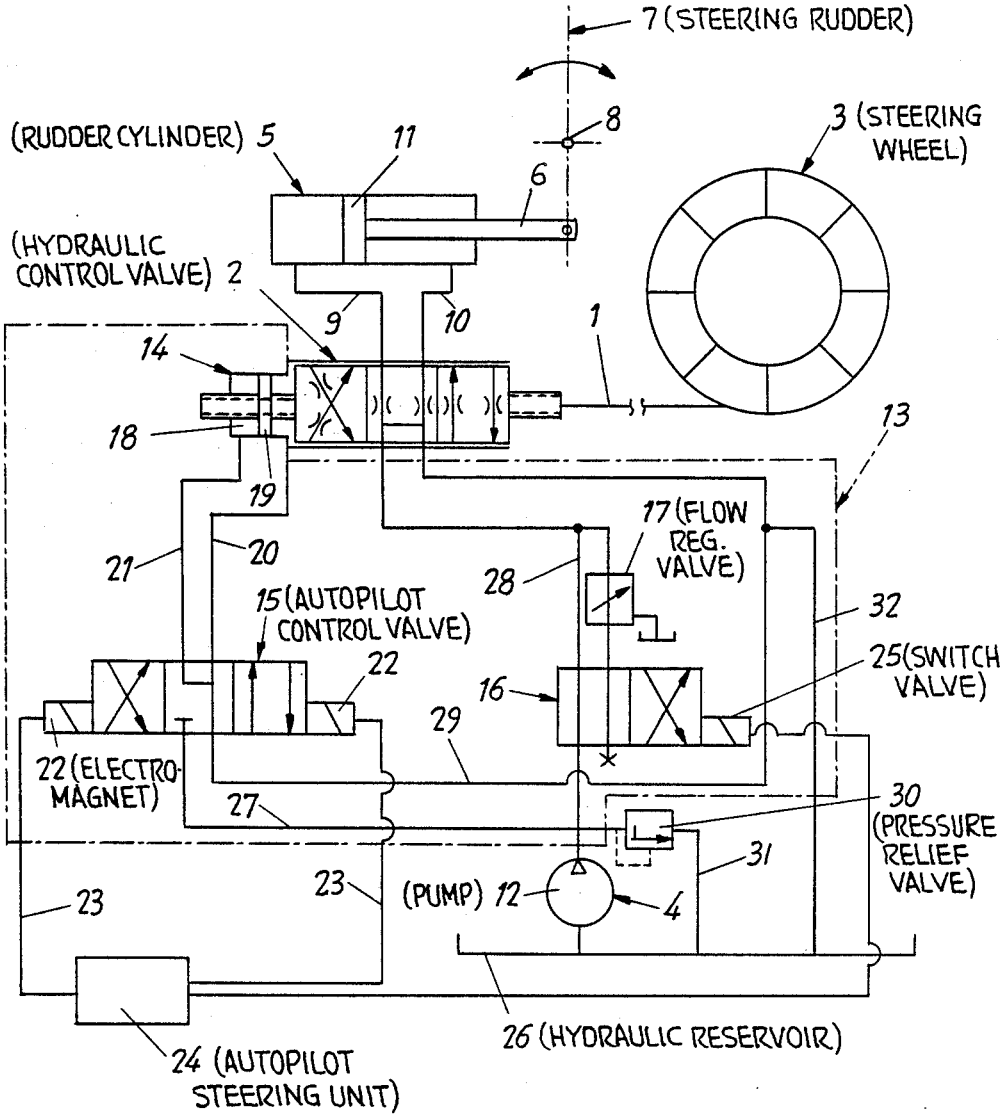
7 (STEERING RUDDER)
8
3 (STEERING WHEEL)
(RUDDER CYLINDER) 5
11
6
(HYDRAULIC CONTROL VALVE) 2
9
10
1
14
18
19
13
17 (FLOW REG. VALVE)
21
20
28
15 (AUTOPILOT CONTROL VALVE)
32
22
25 (SWITCH VALVE)
16
29
22 (ELECTRO-MAGNET)
27
30 (PRESSURE RELIEF VALVE)
31
23
23
(PUMP) 12
4
26 (HYDRAULIC RESERVOIR)
24 (AUTOPILOT STEERING UNIT)

SERVO STEERING SYSTEM FOR MOTOR BOATS

SUMMARY OF THE INVENTION

The invention relates to a servo steering system for motor boats, comprising a steering wheel which mechanically acts on the position of a hydraulic control valve, and a rudder cylinder connected to a hydraulic power unit by way of the control valve. Servo steering systems of the aforesaid type are known and particularly when used in connection with high-power drive motors provide assistance in overcoming the steering forces which at high speed are considerable. In addition to direct operation of a steering rudder, the rudder cylinder which is connected to the hydraulic power unit by way of the control valve can for example act on a corresponding adjustable power transmission comprising a screw or the like.

A particular drawback of known servo steering systems of the aforesaid type is that no autopilot steering is possible with them, or that known autopilot steering systems either cannot be separately used or can only be used at disproportionately high expense.

The object of the present invention is to improve a servo steering system of the initially described type such that the noted drawbacks of known constructions do not arise, in particular by making it possible in a simple and cost-effective manner to use a reliably operating autopilot steering system as an alternative to servo-assisted manual steering at choice.

This is attained according to the present invention in that the control valve comprises an additional adjustment unit which is connected to an autopilot unit and is controllable by this latter. By this means, autopilot steering is made possible in a very simple manner, by merely disposing in the hydraulic circuit an appropriately formed control valve which is in any case required for the servo steering system. The autopilot unit acts, in accordance with the known manner of operation of such devices, directly on the control valve of the servo steering system, by which means the facility for manual steering advantageously remains completely unaffected, to change over to manual steering it being necessary only to switch off the autopilot steering unit.

According to a preferred embodiment of the invention, the adjustment unit is in the form of a hydraulic cylinder-piston arrangement, between the autopilot unit and the adjustment unit there being disposed an autopilot control valve likewise connected to the hydraulic power unit. The adjustment unit by means of its hydraulic cylinder-piston arrangement consequently forms an operating piston which acts on the control valve of the autopilot steering unit and is connected by way of the autopilot control valve—which can be adjusted magnetically by the autopilot steering unit—to the hydraulic power unit provided for the servo steering system.

According to a further embodiment of the invention, the adjustment unit comprises an electromagnet or electric motor operable by the autopilot unit. In this manner, the aforesaid additional autopilot control valve and its corresponding hydraulic equipment can be dispensed with, thus representing a particularly cost-saving embodiment for smaller operating powers or smaller motor boats.

The invention is described in detail hereinafter with reference to the embodiment illustrated schematically in the FIGURE.

The servo steering system for a motor boat, now shown, comprises substantially a steering wheel 3 which acts mechanically—for example by means of an operating cable 1 or the like—on the position of a hydraulic control valve 2, and a rudder cylinder 5 which is connected to a hydraulic power unit 4 by way of the control valve 2 and of which the piston rod 6 effects the rotation of a steering rudder 7 about an axis 8. The two pressure lines to the rudder cylinder 5 are indicated by 9 and 10 and the piston of the rudder cylinder 5 is indicated by 11.

Between the pump 12 of the hydraulic power unit 4 and the control valve 2 there is provided a steering unit 13 to allow autopilot steering and comprising substantially an additional adjustment unit 14 for the control valve 2 and independent of the steering wheel 3, an autopilot control valve 15, a valve 16 and a three-way flow regulator valve 17. The adjustment unit 14, which comprises a cylinder 18 and a piston 19, is connected by way of hydraulic lines 20, 21 to the autopilot control valve 15 which is connected by way of electromagnets 22 and lines 23 to an autopilot unit 24 and is therefore controlled by this latter.

The electromagnet 25 on the valve 16 is also connected to the autopilot unit 24 to allow change-over during autopilot operation to a volumetric flow which is set by the flow regulator valve 17.

A hydraulic reservoir is indicated by 26, the pressure line from the power unit 4 to the autopilot control valve by 27, the direct feed line from the power unit 4 to the control valve 2 by 28, the connection line between the autopilot control valve 15 and control valve 2 by 29, the controlled return flow from the pressure relief valve 30 by 31 and the return flow from the connection line 29 by 32.

When the autopilot unit 24 is activated and autopilot steering put into operation, the valve 16 changes over from its illustrated position to its other position, so that the pump flow is fed from the power unit 4 through the flow control valve 17 by which it is set to a limited volumetric flow rate. Thus only this limited volumetric flow rate reaches the control valve 2, with the result that the regulating speed of the piston 11 can be fixed and finely controlled. If the steering rudder 7 requires adjustment (course correction to right or left) by means of the piston rod 6 or piston 11, the autopilot control valve 15 is switched-over by the autopilot unit 24 from its illustrated middle position to its right or left position. The piston 19 of the adjustment unit 14 is then urged to the left or right side by the pump pressure to thus adjust the valving element of the control valve 2. The hydraulic flow from the power unit 4 can then correspondingly flow into the rudder cylinder 5 to adjust the piston 11 or piston rod 6 and the steering rudder 7. When the required position is reached, the autopilot control valve 15 is again changed over into the illustrated middle position and the valve 16 returned to the illustrated position.

During manual steering by the steering wheel 3, any adjustment of the valving element of the control valve 2 is done by the operating cable 1, by which the hydraulic power unit 4 is able to directly adjust the position of the piston 11 in the rudder cylinder 5 without the cooperation of the autopilot adjustment unit 24 or valve 16 and autopilot control valve 15. During manual steering, the steering force is therefore independent of the load on the rudder, this being a great advantage particularly in the case of large boats or high-power drives.

Instead of the hydraulic adjustment unit 14 with its piston 19 and the autopilot control valve 15, an electromagnet or the like could be used directly for adjusting the valving element of the control valve 2, which would then be directly controlled by the autopilot unit 24.

Furthermore, instead of the flow regulator valve 17, an adjustable or constant throughput small-delivery pump could be provided and used in particular for autopilot operation.

What is claimed is:

1. A servo steering system for motor boats comprising a steering wheel, a rudder which can be pivoted about an axis, a hydraulic control valve having a control element therein, connection means connecting said control element with said steering wheel so that said steering wheel can move said control element within said hydraulic control valve, a hydraulic power unit, first hydraulic transmission means which connects said hydraulic power unit to said hydraulic rudder cylinder via said hydraulic control valve such that movement of said control element in said hydraulic control valve controlling the flow of hydraulic fluid from said hydraulic power unit to said hydraulic rudder cylinder and thus controlling pivoting of said rudder about said axis, a steering unit which includes an additional adjustment unit connected to said control element to move said control element within said hydraulic control valve, and an autopilot unit operatively connected to said additional adjustment unit to control operation of said additional adjustment unit.

2. A servo steering system according to claim 1, wherein said additional adjustment unit comprises a hydraulic cylinder-piston arrangement, and wherein said autopilot unit further comprises an autopilot control valve connected via second hydraulic transmission means to said hydraulic power unit and said hydraulic cylinder-piston arrangement.

3. A servo steering system according to claim 1, wherein said additional adjustment unit comprises an electromagnet.

4. A servo steering system according to claim 1, wherein said additional adjustment unit comprises an electric motor.

* * * * *